US011655595B1

(12) United States Patent
Guo et al.

(10) Patent No.: US 11,655,595 B1
(45) Date of Patent: May 23, 2023

(54) ADJUSTABLE DEVICE FOR RAILWAY TO CROSS ACTIVE FAULTS

(71) Applicant: INSTITUTE OF GEOLOGY AND GEOPHYSICS, CHINESE ACADEMY OF SCIENCES, Beijing (CN)

(72) Inventors: Songfeng Guo, Beijing (CN); Shengwen Qi, Beijing (CN); Manchao He, Beijing (CN); Hui Zhou, Wuhan (CN); Yu Zou, Beijing (CN); Zhiqing Li, Beijing (CN); Lihui Li, Beijing (CN); Bowen Zheng, Beijing (CN); Jinxuan Li, Hanzhong (CN); Guangming Luo, Xingning (CN); Fengjiao Tang, Feicheng (CN); Weiluan Wen, Guangxi (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/894,346

(22) Filed: Aug. 24, 2022

(30) Foreign Application Priority Data

Mar. 21, 2022 (CN) ..... 2022102744006

(51) Int. Cl.
*E01B 9/66* (2006.01)

(52) U.S. Cl.
CPC ..... *E01B 9/66* (2013.01)

(58) Field of Classification Search
CPC ..... E01B 3/16; E01B 3/20; E01B 9/66
See application file for complete search history.

(56) References Cited

U.S. PATENT DOCUMENTS 1,626,517 A * 4/1927 Curry ..... E01B 3/16 238/338

FOREIGN PATENT DOCUMENTS

CN 104937170 A 9/2015
CN 107059500 A 8/2017
(Continued)

OTHER PUBLICATIONS

CNIPA, Notification to grant patent right for invention in CN202210274400.6, dated May 6, 2022.
(Continued)

*Primary Examiner* — Robert J McCarry, Jr.
(74) *Attorney, Agent, or Firm* — Zhigang Ma

(57) ABSTRACT

An adjustable device for railway to cross active faults is provided to fix a rail and a sleeper, including: a fastener mounting base, disposed between the rail and sleeper; clamping pipes, disposed between the fastener mounting base and the sleeper, the sleeper is provided with a through groove, and the clamping pipes are detachably fixed inside the through groove; control parts, disposed on an inner wall of the clamping pipes, each of the control parts is configured to detect lateral pressures between the fastener mounting base and corresponding one of the clamping pipes, thereby to separate the corresponding one of the clamping pipes from the through groove, the device ensures that the rail will not produce bending deformations after the lateral dislocation of the bottom layer during earthquake events, and ensure that a train or rail repair vehicle can pass at a low speed after earthquake.

8 Claims, 4 Drawing Sheets

(56) References Cited

FOREIGN PATENT DOCUMENTS

| | | | |
|---|---|---|---|
| CN | 111560795 | A | 8/2020 |
| CN | 113463449 | A | 10/2021 |
| CN | 113479539 | A | 10/2021 |
| CN | 114134766 | A | 3/2022 |
| JP | H09268504 | A | 10/1997 |
| JP | 2020105796 | A | 7/2020 |

OTHER PUBLICATIONS

Institute of Geology and Geophysics, Chinese Academy of Sciences (Applicant), Original (allowed) claims for CN202210274400.6, Mar. 21, 2022.

* cited by examiner

ADJUSTABLE DEVICE FOR RAILWAY TO CROSS ACTIVE FAULTS

TECHNICAL FIELD

The disclosure relates to a technical field of railways, in particular to an adjustable device for railway to cross active faults.

BACKGROUND

In recent years, China has successively planned and implemented the Sichuan-Tibet railway, the Yunnan-Tibet railway, and other linear transportation projects in the Qinghai-Tibet Plateau and its surrounding areas. However, under continuous compressions of the Indian plate, the Qinghai-Tibet Plateau has not only a great uplift, but also a strong horizontal tectonic movement. Some active faults have been formed in the transition zone between the plateau and the surrounding basin (e.g., Sichuan Basin), and a dislocation rate of two plates of the active fault can reach several centimeters per year. Locations of traffic lines are often difficult to completely keep away from the active faults. The dislocation of the active fault, especially a co-seismic dislocation, can directly dislocate sub-grade, tunnels, and other engineering buildings. Besides seismogenic faults, secondary faults in seismic area will also produce the co-seismic dislocation. The co-seismic dislocation will damage the sub-grade and underground structures of railway crossing the active faults during earthquake events. Therefore, an adjustable device for railway to cross active faults is provided.

SUMMARY

Embodiments of the disclosure are provided to solve or improve at least one of the above problems existing in the prior art.

The first embodiment of the disclosure provides an adjustable device for railway to cross active faults.

The first embodiment of the disclosure provides the adjustable device for railway to cross active faults, the device is configured to fix a rail and a sleeper and includes: a fastener mounting base, disposed between the rail and sleeper; clamping pipes, disposed between the fastener mounting base and the sleeper, the sleeper being provided with a through groove, and the clamping pipes being detachably fixed inside the through groove; control parts, disposed on inner walls of the clamping pipes respectively. Each of the control parts is configured to detect lateral pressures between the fastener mounting base and corresponding one of the clamping pipes, thereby to separate the corresponding one of the clamping pipes from the through groove; and the clamping pipes are detachably matched with the through groove of the sleeper, thereby the rail and the sleeper are fixed again after a relative sliding.

The disclosure provides the adjustable device for railway to cross active faults, the rail is lapped and supported on the sleeper by using the prior art to ensure a normal erection and train traffic. Due to the through groove is disposed on the sleeper, the rail can move along a disposed direction of the through groove. Through a detachable fixing mode between the clamping pipe and the through groove, and under a detection and control of the control part, the clamping pipe is separated from the through groove, so that the sleeper and the rail slide relatively under an effect of a lateral dislocation of a bottom layer, thereby to avoid the deformation of the rail caused by a lateral bending of the sleeper caused by the movement of the bottom layer. After the movement of the bottom layer stop, the control part stops driving the clamping pipe, and the clamping pipe is clamped and fixed with insides of the through groove again.

The disclosure ensures the rail will not produce bending deformations after the lateral dislocation of the bottom layer, and ensures that a train or rail repair vehicle can pass at a low speed after earthquake. On the one hand, it can avoid a derailment which results in dangerous accidents and economic losses when the train passes through after the lateral dislocation of the bottom layer. On the other hand, it can ensure passages and arrivals of vehicles for observation and emergency repair, thereby to carryout timely local repair and emergency repair.

In addition, the disclosure provides technical schemes of embodiments that have the following technical characteristics.

In an embodiment, each of the control parts includes: pressure sensors and an electromagnet, the pressure sensors and the electromagnet are separately fixed on an inner wall of the corresponding one of the clamping pipes, and each of the pressure sensors is configured to detect the pressure between the fastener mounting base and the corresponding one of the clamping pipes, the pressure sensor converts the pressure into an electrical signal, and transmits the electrical signal to the electromagnet, and the electromagnet is configured to control the corresponding one of the clamping pipes to separate from the through groove.

In the embodiment, the pressure sensor is electrically connected to the electromagnet and an external power supply. The pressure sensor is configured to detect the pressure between the fastener mounting base and the clamping pipe, and the pressure sensor controls the electromagnet to start by converting a pressure signal into the electrical signal. The electromagnet controls the movement of the clamping pipe to make the clamping pipe move upward and separate from an inner wall of the through groove, thereby to separate the rail and the sleeper, and the rail and the sleeper slide relatively.

In an embodiment, a side wall of each of the clamping pipes is provided with sliding holes, a bottom of an inner wall of each of the sliding holes is fitted with a clamping block, and an upper surface of the clamping block is connected to a top of the inner wall of the sliding hole through a spring; an end of the clamping block which is close to an axis of the clamping pipe corresponds to the electromagnet longitudinally, and the clamping block is clamped with the through groove.

In the embodiment, through a fitting between the sliding hole and the clamping block, a longitudinal sliding between the clamping block and the clamping pipe can be achieved, thereby the clamping block can be clamped and separated from the inner wall of the through groove. The clamping block can be clamped and fixed down to the inner wall of the through groove under a reset action of gravity or the spring, thereby to realize an automatic fixing again after a dislocation movement between the rail and the sleeper.

In an embodiment, a lower surface of the clamping block is provided with first oblique tooth grooves, an inner wall of the through groove is provided with second oblique tooth grooves, and the second oblique tooth grooves are clamped with the first oblique tooth grooves; the number of the clamping block disposed on each of the clamping pipes is two, and the two clamping blocks are disposed symmetrically around the axis of the clamping pipe.

In the embodiment, a direction of a clamping limit can be selected through oblique teeth of the first oblique tooth grooves and the second oblique tooth grooves. A shape of the oblique tooth can be specifically set as a right-angle triangle, right-angle sides are responsible for a butting limit, and an oblique side is responsible for a guiding sliding, thereby to separate the first oblique tooth grooves and the second oblique tooth grooves, and realize a complete occlusion through the sliding of a contact inclined plane when the first oblique tooth grooves and the second oblique tooth grooves are butted again;

the right-angle sides of the first oblique tooth grooves of the two rotationally symmetric clamping blocks correspond laterally, ensuring that clamping positions of the clamping blocks along two ends of the rail correspond laterally.

In an embodiment, a first protrusion and a second protrusion are respectively disposed on two opposite sides of an inner wall of the through groove, and the first protrusion and the second protrusion are disposed correspondingly in a longitudinal direction.

In the embodiment, through setting the first protrusion and the second protrusion, a middle position of the through groove is protruded outward, which ensures that the second oblique tooth grooves can provide an internal longitudinal shielding, thereby to avoid external objects from contacting with the second oblique tooth grooves when falling into the through groove, and affect a clamping occlusion between the first oblique tooth groove and the second oblique tooth groove. The first protrusion and the second protrusion adopt a lateral block structure, and thereby a longitudinal section of the through groove is a cross shape.

In an embodiment, a signal generator is fixedly disposed on a side wall of the fastener mounting base, the signal generator is electrically connected to the pressure sensors through wires, a side wall of each of the clamping pipes is provided with through-holes, and the wires pass through the through-holes.

In the embodiment, through installing the signal generator, the electrical signal output by the pressure sensors can be output to a remote receiving end, which ensures that a staff at the remote receiving end can understand a fixed relationship between the rail and the sleeper at the first time, thereby can timely report to an external vehicle control center and discharge the rail vehicles for emergency repair. An internal conduction connection of the clamping pipes can be made to wires through the through-holes, thereby to connect the power.

In an embodiment, the fastener mounting base is fixed with the rail through butting plates, bolts penetrate through the fastener mounting base, a top of each of the bolts and an upper surface of corresponding one of the butting plates are fixed through a fastener, a side wall of each of the bolts is connected to a rifled pipe, and an outer wall of the rifled pipe is butted with the pressure sensors.

In the embodiment, the fastener adopts a bent steel bar, which can be elastically deformed, thereby when a corresponding bolt moves downward, it can produce prestresses on the butting plate and ensure a stable bolted fixing of the bolt. Through the rifled pipe which is under an effect of the bolt, the rail sequentially passes through the butting plate, the fastener, the bolt, the rifled pipe, the pressure sensor, and the clamping pipe in turn, and finally the rail is fixed with the sleeper.

In an embodiment, a locating ring is fixedly disposed on a top of the outer wall of the rifled pipe, the locating ring is fixedly connected between the fastener mounting base and each of the butting plates.

In the embodiment, the locating ring can be fixed to the rifled pipe when a bottom side of the rail and the fastener mounting base are pressed down by the butting plates, thereby to avoid an offset of the rifled pipe, and ensure that two pressure sensors inside the clamping pipe can normally sense pressure values between the clamping pipe and the rifled pipe.

In an embodiment, an outer wall of the sleeper is fixedly connected to a support plate and rib plates correspondingly, the number of the rib plates is at least two, and lower surfaces of the rib plates are fixedly connected to an upper surface of the support plate.

In the embodiment, the sleeper is additionally strengthened through the rib plates to avoid overall structural instabilities caused by a disposition of the through groove, resulting in damages or even fractures of the sleeper, and ensure a service life of the sleeper is stable during a long-term operation.

Additional aspects and advantages of the embodiments according to the disclosure will become apparent in the following description, or will be known through practice according to embodiments of the disclosure.

DESCRIPTION OF REFERENCE NUMERALS

1—rail, 2—sleeper, 201—through groove, 2011—second oblique tooth groove, 2012—first protrusion, 2013—second protrusion, 202—support plate, 203—rib plate, 3—fastener mounting base, 301—butting plate, 302—bolt, 303—fastener, 304—rifled pipe, 3041—locating ring, 4—clamping pipe, 401—sliding hole, 402—clamping block, 4021—first oblique tooth groove, 403—spring, 404—through-hole, 5—pressure sensor, 6—electromagnet, 7—signal generator.

DETAILED DESCRIPTION OF EMBODIMENTS

In order to clearly understand the above purposes, characteristics and advantages of the disclosure, the disclosure is further described in detail below in combination with illustrated diagrams and specific embodiments. It should be noted that the embodiments of the disclosure and the characteristics in the embodiments can be combined with each other without conflicts Many specific details are described in following descriptions to facilitate a full understanding of the disclosure. However, the disclosure can also be implemented in other ways different from those described here. Therefore, a scope of protections in the disclosure is not limited by the specific embodiments disclosed below.

Figure 1:
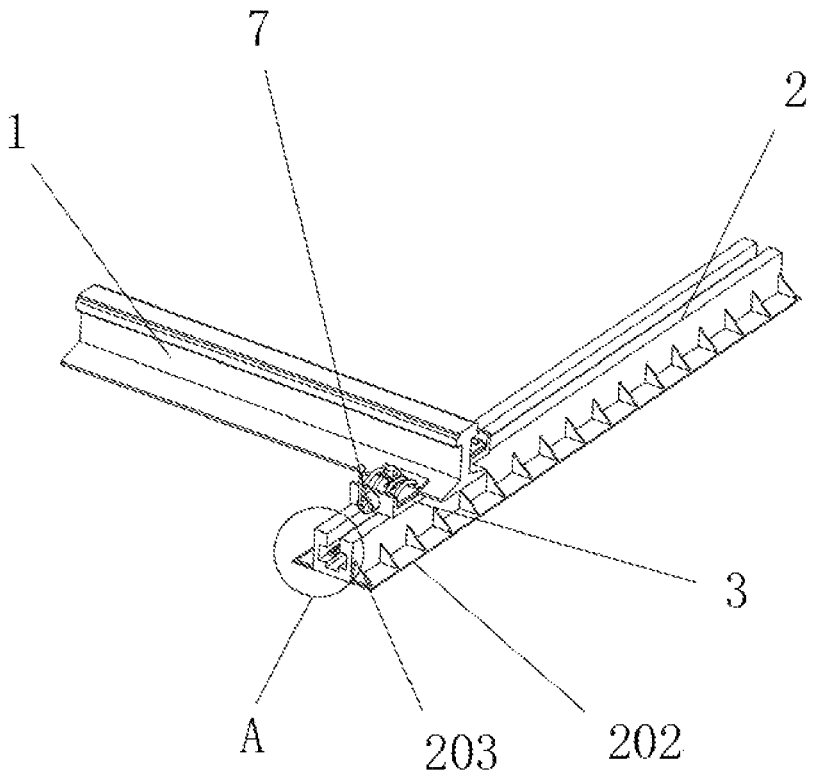
FIG. 1 illustrates a structural schematic diagram of an adjustable device for railway to cross active faults fixing a rail and a sleeper of the disclosure.
Figure 2:
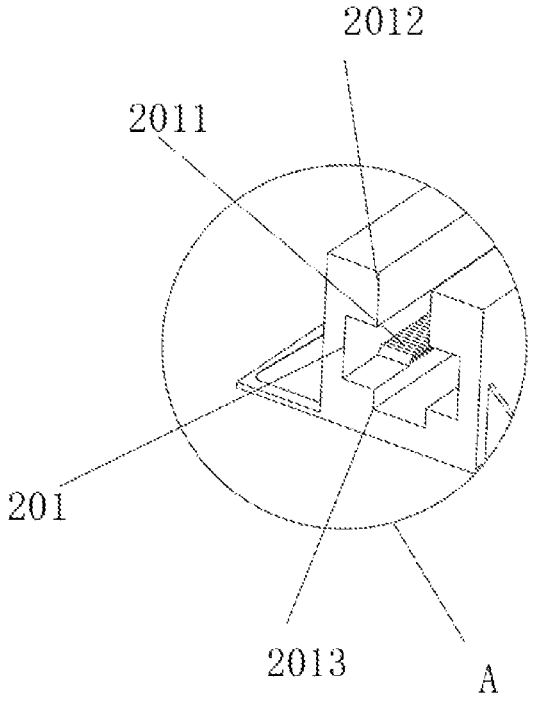
FIG. 2 illustrates an enlarged schematic diagram at A in FIG. 1.
Figure 3:
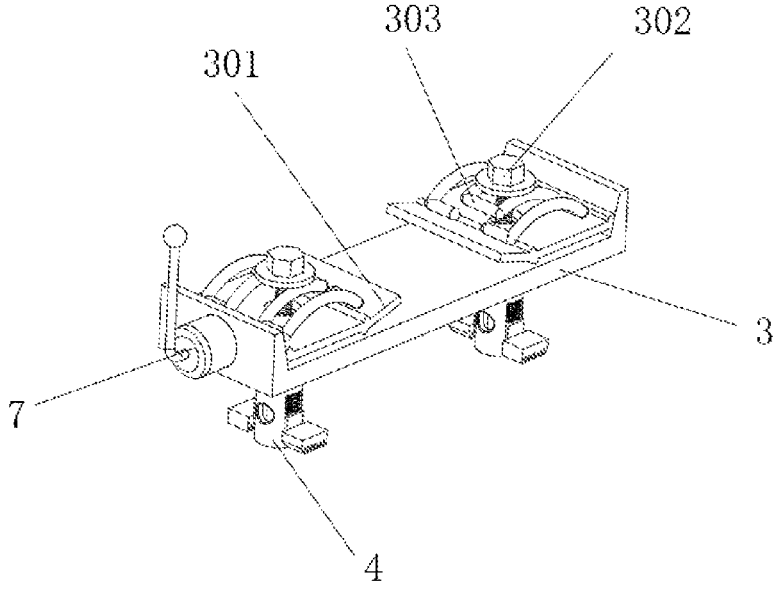
FIG. 3 illustrates a schematic diagram of a fastener mounting base and its connection structures of the disclosure.
Figure 4:
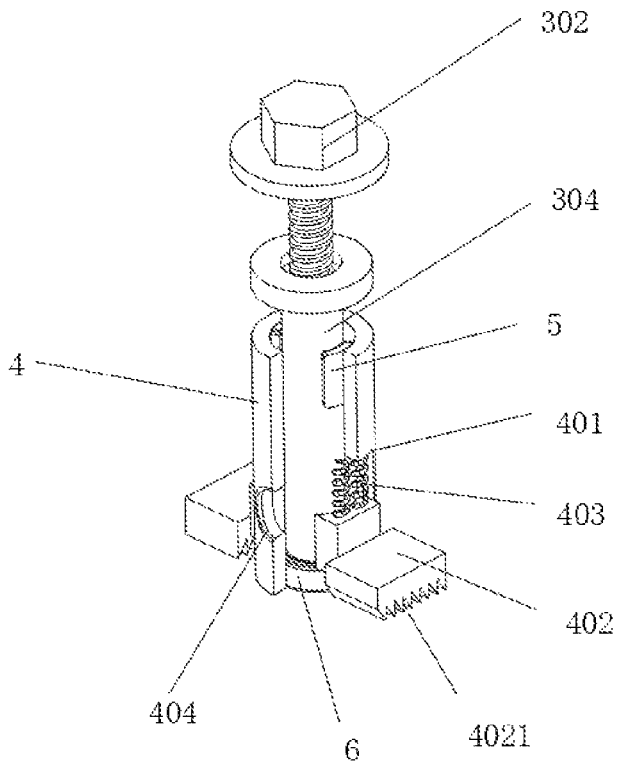
FIG. 4 illustrates a schematic diagram of a pipe body of a clamping pipe after local sectioning and its connection structures in the disclosure.
Figure 5:
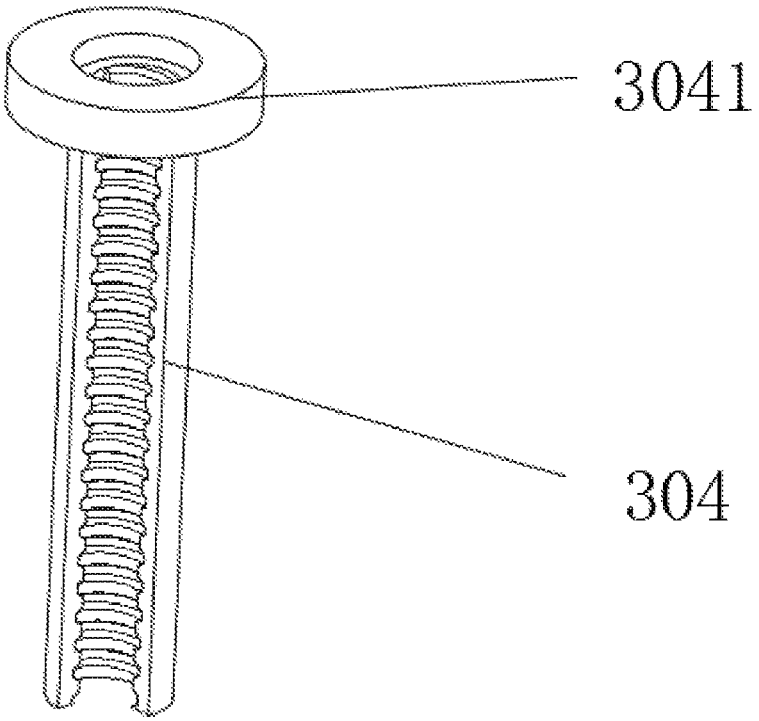
FIG. 5 illustrates a schematic diagram of a rifled pipe after local sectioning and its connection structures in the disclosure.

Refer to FIG. 1 to FIG. 5, a first embodiment of the disclosure provides the adjustable device for railway to cross active faults, the device is configured to fix a rail 1 and a sleeper 2. The device includes a fastener mounting base 3, clamping pipes 4 and control parts. The fastener mounting base 3 is disposed between the rail 1 and sleeper 2. The clamping pipes 4 are disposed between the fastener mounting base 3 and the sleeper 2, the sleeper 2 is provided with a through groove 201, and the clamping pipes 4 are detachably fixed inside the through groove 201. The control parts are disposed on inner walls of the clamping pipe 4 respectively, each of the control parts is configured to detect lateral pressures between the fastener mounting base 3 and corresponding one of the clamping pipes 4, thereby to separate the corresponding one of the clamping pipes 4 from the through groove 201. The clamping pipes 4 can be detachably matched with the through groove 201 of the sleeper 2, thereby the rail 1 and the sleeper 2 can be fixed again after a relative sliding.

The disclosure provides the adjustable device for railway to cross active faults, the rail 1 is lapped and supported on the sleeper 2 by using the prior art to ensure a normal erection and train traffic. Due to the through groove 201 is disposed on the sleeper 2, the rail 1 can move along a disposed direction of the through groove 201. Through a detachable fixing mode between the clamping pipe 4 and the through groove 201, and under a detection and control of the control part, the clamping pipe 4 is separated from the through groove 201, so that the sleeper 2 and the rail 1 slide relatively under an effect of a lateral dislocation of a bottom layer, thereby to avoid the deformation of the rail 1 caused by the lateral bending of the sleeper 2 caused by the movement of the bottom layer. After the movement of the bottom layer stops, the control part stops driving the clamping pipe 4, and the clamping pipe 4 is clamped and fixed with insides of the through groove 201 again.

The disclosure ensures the rail 1 will not produce bending deformations after the lateral dislocation of the bottom layer, and ensure that a train or rail repair vehicle can pass at a low speed after earthquake. On the one hand, it can avoid a derailment which results in dangerous accidents and economic losses when the train passes through after the lateral dislocation of the bottom layer. On the other hand, it can ensure passages and arrivals of vehicles for observation and emergency repair, thereby to carryout timely local repair and emergency repair.

Specifically, the sleeper 2 can keep horizontal with a gap at a fault of the bottom layer, ensuring that a lateral force is consistent with a sliding direction between the rail 1 and the sleeper 2.

In an embodiment, as shown in FIG. 1 to FIG. 5, each of the control parts includes: pressure sensors 5 and an electromagnet 6 are separated each other, the pressure sensors 5 and the electromagnet 6 are separately fixed on an inner wall of the corresponding one of the clamping pipes 4. Each of the pressure sensors 5 is configured to detect pressure between the fastener mounting base 3 and the corresponding one of the clamping pipes 4, the pressure sensor 5 converts the pressure into an electrical signal and transmits the electrical signal to the electromagnet 6, and the electromagnet 6 is configured to control the corresponding one of the clamping pipes 4 to separate from the through groove 201.

In the embodiment, the pressure sensor 5 is electrically connected to the electromagnet 6 and an external power supply. The pressure sensor 5 is configured to detect the pressure between the fastener mounting base 3 and the clamping pipes 4, and the pressure sensor 5 controls the electromagnet 6 to start by converting a pressure signal into the electrical signal. The electromagnet 6 controls the movement of the clamping pipe 4 to make the clamping pipe 4 move upward and separate from an inner wall of the through groove 201, thereby to separate the rail 1 and the sleeper 2, and the rail 1 and the sleeper 2 slide relatively.

Specifically, the pressure sensor 5 adopts a kind of ceramic pressure sensor 5, and a threshold switch is disposed between the pressure sensor 5 and the electromagnet 6. When the pressure sensor 5 outputs an electrical signal of a certain value, the electromagnet 6 is started. After the electromagnet 6 is started, there is a magnetic repulsion force between the electromagnet 6 and the clamping block 402, and a magnet can be embedded on the clamping block 402.

Further details, a threshold value of a predetermined value can be set to enable the electromagnet 6 to slide between the rail 1 and the sleeper 2 when there is a certain degree of a pulling force on the rail 1. The threshold value of a force depends on a strength of a connecting device between the rail 1 and the sleeper 2, and can be set in a range of ⅓ to ⅔ of a bearing force of the connecting device. For example, if the connecting device used is made of the following materials.

A sectional area: 3.89 $cm^2$ (the contact area between a single clamp block 402 and the through groove 201), a strength of section steel: 215 $N/mm^2$, then the maximum force that the connecting device can bear is 83.6 KN, and a suggested threshold value of the connecting device is in a range of 28 to 56 KN (about ⅓ to ⅔ of the maximum force); the electromagnet 6 can be started before bending deformations of the rail 1 and the electromagnet 6 will not be frequently started due to small vibrations.

In an embodiment, as shown in FIG. 1 to FIG. 5, a side wall of each of the clamping pipes is provided with sliding holes, a bottom of an inner wall of each of the sliding holes 401 is fitted with a clamping block 402, and an upper surface of the clamping block 402 is connected to a top of the inner wall of the sliding hole 401 through a spring 403; an end of the clamping block 402 close to an axis of the clamping pipe 4 corresponds to the electromagnet 6 longitudinally, and the clamping block 402 is clamped with the through groove 201.

In the embodiment, through a fitting between the sliding hole 401 and the clamping block 402, a longitudinal sliding between the clamping block 402 and the clamping pipe 4 can be achieved, thereby the clamping block 402 can be clamped and separated from the inner wall of the through groove 201. The clamping block 402 can be clamped and fixed down to the inner wall of the through groove 201 under a reset action of gravity or the spring 403, thereby to realize an automatic fixing again after a dislocation movement between the rail 1 and the sleeper 2.

In an embodiment, as shown in FIG. 1 to FIG. 5, a lower surface of the clamping block 402 is provided with first oblique tooth grooves 4021, an inner wall of the through groove 201 is provided with second oblique tooth grooves 2011, and the second oblique tooth grooves 2011 are clamped with the first oblique tooth grooves 4021; the number of the clamping block 402 disposed on each of the clamping pipes 4 is two, and the two clamping blocks 402 are disposed symmetrically around the axis of the clamping pipe 4.

In the embodiment, a direction of a clamping limit can be selected through the oblique teeth of the first oblique tooth grooves 4021 and the second oblique tooth grooves 2011. A shape of the oblique teeth can be specifically set as a right-angle triangle, right-angle sides are responsible for butting limit, and an oblique side is responsible for guiding sliding, thereby to separate the first oblique tooth grooves 4021 and the second oblique tooth grooves 2011, and to realize a complete occlusion through the sliding of a contact inclined plane when the first oblique tooth grooves 4021 and the second oblique tooth grooves 2011 are butted again; the right-angle sides of the first oblique tooth grooves 4021 of the two rotationally symmetric clamping blocks 402 correspond laterally, ensuring that clamping positions of the clamping blocks 402 along two ends of the rail 1 correspond laterally.

Specifically, a distance between an inner wall of the clamping pipe 4 and an outer wall of a rifled pipe 304 is less than a length of the first oblique tooth groove 4021 along a direction of the through groove 201.

In an embodiment, as shown in FIG. 1 to FIG. 5, a first protrusion 2012 and a second protrusion 2013 are respectively disposed on left and right sides of an inner wall of the through groove 201, and the first protrusion 2012 and the second protrusion 2013 are disposed correspondingly in a longitudinal direction.

In the embodiment, through setting the first protrusion 2012 and the second protrusion 2013, a middle position of the through groove 201 is protruded outward, which ensures that the second oblique tooth grooves 2011 can provide internal longitudinal shielding, thereby to avoid external objects from contacting with the second oblique tooth grooves 2011 when falling into the through groove 201, and affect a clamping occlusion between the first oblique tooth groove 4021 and the second oblique tooth groove 2011. The first protrusion 2012 and the second protrusion 2013 adopt a lateral block structure, thereby a longitudinal section of the through groove 201 is a cross shape.

In an embodiment, as shown in FIG. 1 to FIG. 5, a signal generator 7 is fixedly disposed on a side wall of the fastener mounting base 3, the signal generator 7 is electrically connected to the pressure sensors 5 through wires, a side wall of each of the clamping pipes is provided with through-holes 404, and the wires pass through the through-holes 404.

In the embodiment, through installing the signal generator 7, the electrical signal output by the pressure sensors 5 can be output to a remote receiving end, ensuring that a staff at the remote receiving end can understand a fixed relationship between the rail 1 and the sleeper 2 at the first time, thereby can timely report to an external vehicle control center and discharge the rail 1 vehicles for emergency repair. An internal conduction connection of the clamping pipes 4 can be made to wires through the through-holes 404, thereby to connect the power.

Specifically, the signal generator 7 can realize a data interaction through communication means based on Bluetooth, Wi-Fi (Wireless Fidelity, a wireless local area network based on IEEE (Institute of Electrical and Electronics Engineers) 802.11b standard), infrared, purple bee, and mobile cellular technology, but the communication means are not limited to these.

In an embodiment, as shown in FIG. 1 to FIG. 5, the fastener mounting base 3 is fixed with the rail 1 through butting plates 301, bolts 302 penetrate through the fastener mounting base, a top of each of the bolts 302 and an upper surface of corresponding one of the butting plates 301 are fixed through a fastener 303, a side wall of each of the bolts 302 is connected to a rifled pipe 304, and an outer wall of the rifled pipe 304 is butted with corresponding pressure sensors 5.

In the embodiment, the fastener 303 adopts a bent steel bar, which can be elastically deformed, thereby when the bolt 302 moves downward, it can produce prestresses on the butting plate 301, and ensuring a stable bolted fixing of the bolts 302. Through the rifled pipe 304 which is under an effect of the bolts 302, the rail 1 sequentially passes through the butting plate 301, the fastener 303, the bolt 302, the rifled pipe 304, the pressure sensors 5, and the clamping pipe 4 in turn, and the rail 1 finally is fixed with the sleeper 2.

In an embodiment, as shown in FIG. 1 to FIG. 5, a locating ring 3041 is fixedly disposed on a top of the outer wall of the rifled pipe 304, the locating ring is fixedly connected between the fastener mounting base and each of the butting plates.

In the embodiment, the locating ring 3041 can be fixed to the rifled pipe 304 when a bottom side of the rail 1 and the fastener mounting base 3 are pressed down by the butting plates 301, thereby to avoid an offset of the rifled pipe 304, and ensure that two pressure sensors 5 inside the clamping pipe 4 can normally sense pressure values between the clamping pipe 4 and the rifled pipe 304.

In an embodiment, as shown in FIG. 1 to FIG. 5, an outer wall of the sleeper 2 is fixedly connected to a support plate 202 and rib plates 203 correspondingly, the number of the rib plates 203 is provided with at least two, and lower surfaces of the rib plates 203 are fixedly connected to an upper surface of the support plate 202.

In the embodiment, the sleeper 2 is additionally strengthened through the rib plates 203 to avoid overall structural instabilities caused by a disposition of the through groove 201, resulting in damages or even fractures of the sleeper 2, and ensure a service life of the sleeper 2 is stable during a long-term operation.

Specifically, the device of the disclosure can be mixedly used with an ordinary sleeper 2 to ensure a firm fixing on a normal and stable location. The following methods can be adopted when selecting the location where exists a fault of a bottom layer.

With the development of a transportation planning, construction and operation of the rail 1 in surrounding areas of the Qinghai-Tibet Plateau, it is inevitable that some rails 1 will cross active faults. For solving the problem of the linear projects must cross the active faults, a method of large-angle passing is generally adopted. For locations of the active faults, large active faults have been marked in a general geological map (such as a 1:1000000 structural map of the Qinghai-Tibet Plateau, and an approximate location of the Xianshuihe fault and the Jinshajiang fault crossed by the Sichuan-Tibet railway is basically clear). However, these faults generally have small scales, during a preliminary survey and construction of routes, the locations of the active faults can be identified by following technical methods:

(1) geological characteristics; the active faults generally stagger the latest sediments; mylonite, fault gouge, fault scratch, and other fault zone features, loose but not cemented; and incongruent contacts and discontinuities of two plates at a fault;

(2) geomorphic characteristics; the active faults often define a boundary between two distinct geomorphic units, and enlarge the difference of each geomorphic unit. The active faults often cause a decomposition and an abnormality of the same geomorphic unit or a geomorphic system; when a series of river valleys are offset in a direction at the same time, the phenomenon can be identified as a sign of a location where exist the active faults;

(3) hydrogeological characteristics; along faults, springs are distributed in line, and vegetation is developed;

(4) displacement characteristics; a displacement can be calculated by InSAR (Interferometric Synthetic Aperture Radar), GPS (Global Positioning System), and other technical means. If a displacement on both sides of a fault is obviously inconsistent, it indicates that the fault zone is active and a location of the fault zone can be determined.

Operation principles: when a fault of a bottom layer occurs, an extrusion force between the rail 1 and the sleeper 2 located near the dislocation fault is generated. The extrusion force specifically affects each of pressure sensors 5 between a rifled pipe 304 and a clamping pipe 4 (the sleeper 2 transmits the extrusion force to the clamping blocks 402 through the mutually occluded first oblique grooves 4021 and second oblique grooves 2011, and finally the extrusion force is transmitted to the clamping pipes 4; at the same time, the rail 1 transmits the extrusion force to the rifled pipes 304 through the butting plates 301, the fasteners 303, the bolts 302 sequentially), when the pressure values of the pressure sensors 5 reach the threshold values respectively, electromagnets 6 are started to make clamping blocks 402 move upward (by a compression of springs 403), then the first oblique grooves 4021 and the second oblique grooves 2011 are separated from each other, thereby the sleeper 2 and the rail 1 slide relatively to offset a dislocation movement of a bottom layer. After the sleeper 2 and the rail 1 stop sliding relatively, each of the pressure sensors 5 loses the pressure, the electromagnets 6 shut down, and the clamping blocks 402 move downward under the reset of the springs 403 and an effect of gravity, thereby the first oblique tooth grooves 4021 and the second oblique tooth grooves 2011 occlude again, and the first oblique tooth grooves 4021 and the second oblique tooth grooves 2011 can slide through the inclined planes which are in a contact with each other, thereby to complete a full occlusion.

In the description of the disclosure, it should be noted that orientation or position relationships indicated by the terms "longitudinal", "lateral", "upper", "lower", "front", "rear", "left", "right", "vertical", "horizontal", "top", "bottom", "inner", "outer" and so on are based on orientation or position relationships shown in the illustrated diagrams, only for the convenience of describing the disclosure, rather than indicating or implying that a device or a unit referred to must have a specific orientation, construction, and operation based on a specific orientation, and it cannot be understood as a limitation of the disclosure.

The above-described embodiments only describe some embodiments of the disclosure and cannot limit a scope of the disclosure. Without departing from a design spirit of the disclosure, various modifications and improvements made by those skilled in the art to a technical scheme of the disclosure should be within the protection scope determined by the claims of the disclosure.

What is claimed is:

1. An adjustable device for railway to cross active faults, configured to fix a rail (1) and a sleeper (2), wherein the device comprises:

a fastener mounting base (3), disposed between the rail (1) and the sleeper (2);

clamping pipes (4), disposed between the fastener mounting base (3) and the sleeper (2), wherein the sleeper (2) is provided with a through groove (201), and the clamping pipes (4) are detachably fixed inside the through groove (201);

control parts, disposed on inner walls of the clamping pipes (4) respectively, wherein each of the control parts is configured to detect lateral pressures between the fastener mounting base (3) and corresponding one of the clamping pipes (4), thereby to separate the corresponding one of the clamping pipes (4) from the through groove (201);

wherein the clamping pipes (4) are detachably matched with the through groove (201) of the sleeper (2), thereby the rail (1) and the sleeper (2) are fixed again after a relative sliding;

wherein each of the control parts comprises: pressure sensors (5) and an electromagnet (6), the pressure sensors (5) and the electromagnet (6) are fixed on the inner wall of the corresponding one of the clamping pipes (4), each of the pressure sensors (5) is configured to detect the pressure between the fastener mounting base (3) and the corresponding one of the clamping pipes (4), the pressure sensor (5) converts the pressure into an electrical signal and transmits the electrical signal to the electromagnet (6), and the electromagnet (6) is configured to control the corresponding one of the clamping pipes (4) to separate from the through groove (201).

2. The adjustable device for railway to cross active faults according to claim 1, wherein a side wall of each of the clamping pipes (4) is provided with sliding holes (401), a bottom of an inner wall of each of the sliding holes (401) is fitted with a clamping block (402), and an upper surface of the clamping block (402) is connected to a top of the inner wall of the sliding hole (401) through a spring (403);

wherein an end of the clamping block (402) close to an axis of the clamping pipe (4) corresponds to the electromagnet (6) longitudinally, and the clamping block (402) is clamped with the through groove (201).

3. The adjustable device for railway to cross active faults according to claim 2, wherein a lower surface of the clamping block (402) is provided with first oblique tooth grooves (4021), an inner wall of the through groove (201) is provided with second oblique tooth grooves (2011), and the second oblique tooth grooves (2011) are clamped with the first oblique tooth grooves (4021);

wherein the number of the clamping block (402) disposed on each of the clamping pipes (4) is two, and the two clamping blocks (402) rotate symmetrically around the axis of the clamping pipe (4).

4. The adjustable device for railway to cross active faults according to claim 1, wherein a first protrusion (2012) and a second protrusion (2013) are respectively disposed on two opposite sides of an inner wall of the through groove (201), and the first protrusion (2012) and the second protrusion (2013) are disposed correspondingly in a longitudinal direction.

5. The adjustable device for railway to cross active faults according to claim 1, wherein a signal generator (7) is fixedly disposed on a side wall of the fastener mounting base (3), the signal generator (7) is electrically connected to the pressure sensors (5) through wires, a side wall of each of the clamping pipes (4) is provided with through-holes (404), and the wires pass through the through-holes (404).

6. The adjustable device for railway to cross active faults according to claim 1, wherein the fastener mounting base (3) is fixed with the rail (1) through butting plates (301), bolts (302) penetrate through the fastener mounting base (3), a top of each of the bolts (302) and an upper surface of corresponding one of the butting plates (301) are fixed through a fastener (303), a side wall of each of the bolts (302) is connected to a rifled pipe (304), and an outer wall of the rifled pipe (304) is butted with the pressure sensors (5).

7. The adjustable device for railway to cross active faults according to claim 6, wherein a locating ring (3041) is fixedly disposed on a top of an outer wall of the rifled pipe (304), the locating ring (3041) is fixedly connected between the fastener mounting base (3) and each of the butting plates (301).

8. The adjustable device for railway to cross active faults according to claim 1, wherein an outer wall of the sleeper (2) is fixedly connected to a support plate (202) and rib plates (203) correspondingly, the number of the rib plates (203) is at least two, and lower surfaces of the rib plates (203) are fixedly connected to an upper surface of the support plate (202).

* * * * *